US008403169B2

(12) United States Patent
Hafellner et al.

(10) Patent No.: US 8,403,169 B2
(45) Date of Patent: Mar. 26, 2013

(54) MOBILE TANK FOR CRYOGENIC LIQUIDS

(75) Inventors: Reinhard Hafellner, Margarethen (AT); Michael Pichler, Kobenz (AT); Andreas Zieger, Graz (AT); Günther Krainz, Graz (AT)

(73) Assignee: MAGNA STEYR Fahrzeugtechnik AG & Co KG, Graz (AT)

( * ) Notice: Subject to any disclaimer, the term of this patent is extended or adjusted under 35 U.S.C. 154(b) by 1742 days.

(21) Appl. No.: 10/956,611

(22) Filed: Oct. 1, 2004

(65) Prior Publication Data

US 2005/0077300 A1 Apr. 14, 2005

(30) Foreign Application Priority Data

Oct. 2, 2003 (DE) ..... 103 45 958

(51) Int. Cl.
*B65D 90/02* (2006.01)

(52) U.S. Cl. ..... 220/560.11; 220/562; 220/560.09; 220/560.1

(58) Field of Classification Search ..... None
See application file for complete search history.

(56) References Cited

U.S. PATENT DOCUMENTS 3,446,388 A * 5/1969 Greenberg ..... 220/562
4,481,778 A 11/1984 Reinker et al.

FOREIGN PATENT DOCUMENTS

DE 101 28 546 12/2002
GB 2 025 029 1/1980

* cited by examiner

*Primary Examiner* — Stephen Castellano
(74) *Attorney, Agent, or Firm* — Bachman & LaPointe, P.C.

(57) ABSTRACT

A tank for cryogenic liquids, which is intended for installation in motor vehicles and which consists of an outer container and of an inner container suspended in the latter in tension or compression struts. In order to take the contrasting requirements in motor vehicles into account in an optimum way, between the outer container and inner container abutments and supporting faces are additionally provided, which can be spaced apart from one another when the vehicle is at a standstill and can be brought to bear when the vehicle is driving. The abutments inside the outer container Co.-operate with supporting faces on the inner container and can be displaced by means of an actuator.

12 Claims, 4 Drawing Sheets

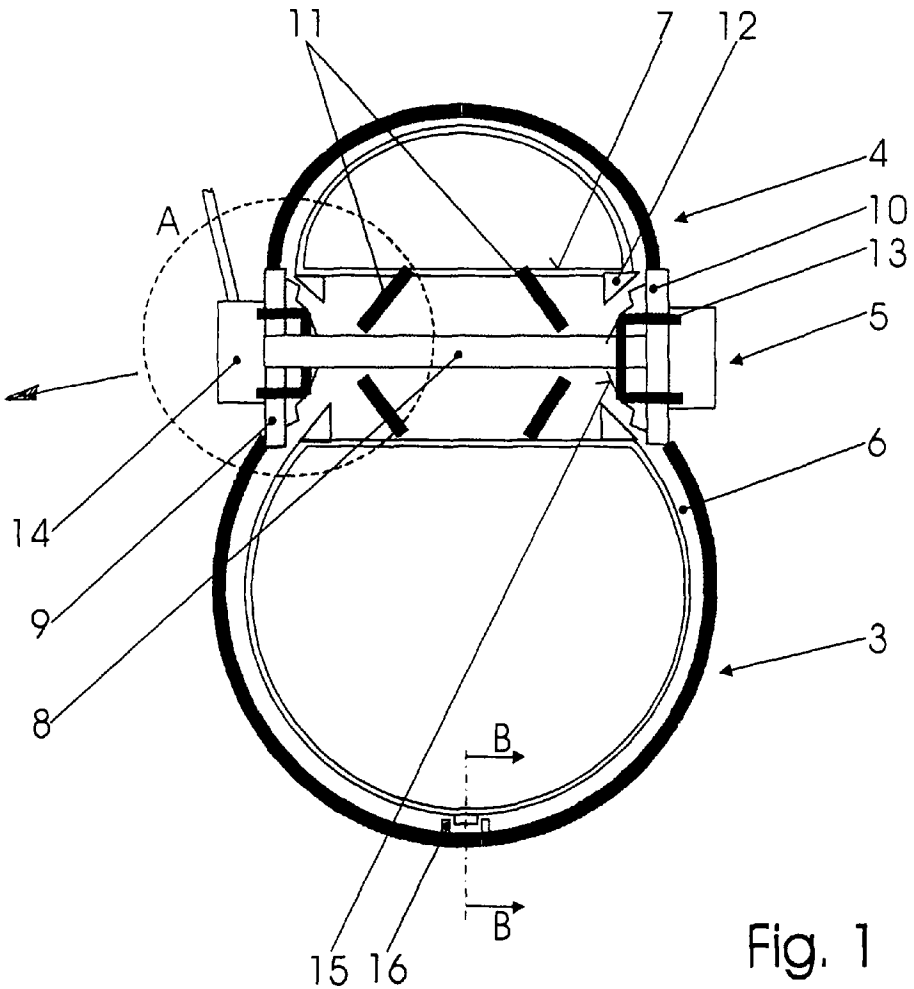
Fig. 1
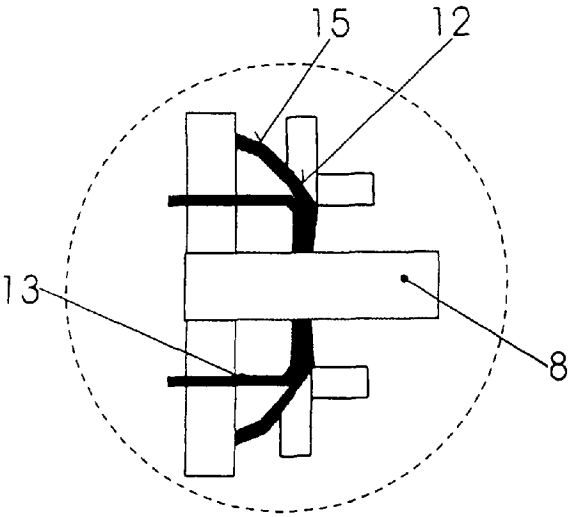

MOBILE TANK FOR CRYOGENIC LIQUIDS

BACKGROUND OF THE INVENTION

The invention relates to tanks for cryogenic liquids, said tanks being intended for installation in motor vehicles and which consists of an outer container and of an inner container suspended in the latter, the suspension being formed by spatially arranged tension or compression struts of low thermal conductivity which compensate for displacements of the inner container due to thermal expansion differences.

A cryotank for rockets is known from U.S. Pat. No. 4,481,778. The bands serving for suspension surround short struts which are articulated on connectors with play on both sides. In the event of the high acceleration occurring in the longitudinal direction during starting, the struts are laid against the connectors. Owing to its application in rocket technology, however, this design does not afford either sufficient cold insulation (the struts are highly effective heat bridges) or sufficient freedom of movement for the inner container.

DE-A-101 28 516 discloses a generic tank for cryogenic liquids, which is intended for use in motor vehicles, with spatially arranged tension or compression struts which engage on a tube mounted centrally in the inner container. These struts are again very strong and thermally conductive components, but cannot withstand more pronounced shocks, let alone collisions.

Further, GB 2 025 029 discloses a storage container for liquid gases, the inner container of which is centered in the outer container by means of the repulsion of permanent magnets.

None of these designs can satisfy the special requirements arising in the event of use in motor vehicles. These are, on the one hand, that the heat insulation is to be particularly good, in order to minimize evaporation (the vehicle must be ready to drive even after being at a standstill for a week and it must be possible to walk around in the garage with a cigarette); and, on the other hand, the support of the inner container must withstand movements and accelerations in all directions, not only those in the event of a collision, but also those constantly occurring due to unevennesses of the road. The object of the invention is to take into account these contrasting requirements in an optimum way.

SUMMARY OF THE INVENTION

The object is achieved, according to the invention, in that, between the outer container and the inner container, restraints, in particular abutments and supporting faces, are additionally provided, which can be spaced apart from one another when the vehicle is at a standstill and can be brought to bear when the vehicle is driving. The invention is based on the recognition, on the one hand, that especially good heat insulation during driving is not necessary, because fuel is in any case extracted continuously, preferably in vapor form, from the tank, and that, on the other hand, a firm support during standstill is not required.

The restraints or abutments and supporting faces do not need to be poor conductors of heat and do not need any special heat insulation since they form heat bridges only during operation. The thus increased evaporation of the cryogenic liquid is even conducive to the extraction of fuel. Owing to the restraints, the spatially arranged tension or compression struts serving for the permanent suspension of the inner container have to support the inner container only with the vehicle at a standstill and can consequently be dimensioned with especially small cross-sections for maximum heat insulation, because no dynamic loads of any kind occur during standstill.

In a practical embodiment, supporting faces are formed on the inner container and the abutments co-operating with said supporting faces are arranged inside the outer container and can be displaced by means of an actuator. The actuator therefore does not need to be accommodated in the sensitive vacuum zone between the outer and the inner container and is accessible from outside. In particular and preferably, the actuator is an electromagnet mounted on the outer container and the abutment is covered by a sealing diaphragm.

In a preferred basic embodiment, the supporting faces are formed on a tubular perforation of the inner container and the abutments co-operating with said supporting faces are formed by/on a hollow body which is arranged inside the outer container and passes through the tubular perforation of the inner container and the form of which can be varied by a variation of the internal pressure, and the hollow body and the supporting faces are centrically symmetrical. The tubular perforation of the inner container and the hollow body passing through the inner container make it possible, as compared with engagement on the periphery of the inner container, to have a symmetrical and virtually thermocentric support and engagement of the abutments. When the spatially arranged tension or compression struts serving for the permanent suspension of the inner container also engage on this hollow body, the advantages mentioned are also beneficial to these struts. Actuation by internal pressure (or, in the case of an appropriate reversal, by under pressure) allows uncomplicated actuation without sealing-off problems.

For this purpose, various embodiments in terms of detail are possible. The hollow body may be connected with its two ends to the outer container by means of, fastenings and the spatially arranged tension or compression struts of the suspension of the inner container also engage on said outer container. This makes it possible to secure the inner container at two mutually opposite points of the hollow body, without direct connection to the outer container, and allows a thermocentric and kinematically optimum suspension of the inner container.

A specialist simple design is obtained when the outer container is deformable in a diaphragm-like manner in the surroundings of the connection point to the hollow body and when the casing of the hollow body is designed at least partially as a bellows. As a result, no movable connections of any kind are necessary on the inside, apart from the compression or tension struts, and the atmospheric pressure acting on the outer container from outside exerts a restoring force on the pressure-loaded bellows (an under pressure or vacuum of course prevails between the two containers). Moreover, the firm connection between the bellows and the outer container increases the load-bearing capacity.

In another embodiment, the hollow body is surrounded by centrically symmetrical bellows-like structures which are expandable by means of internal pressure and which can be laid by the internal pressure against the inner container wall surrounding the hollow body. The bellows-like structures provide a large-area and elastic bearing surface which can absorb considerable shocks and thus effectively protects the inner container.

In a development of the idea of the invention, according to the invention, in generic tanks, inside the outer container and on the outside of the inner container, restraints are additionally provided, which are ineffective when the vehicle is at a standstill and can be coupled when the vehicle is driving, so that a displacement of the inner container and outer container in relation to one another is prevented. This measure can be employed alternatively to or in addition to the abutments. It prevents a displacement in the direction parallel to the container walls, whereas the abutments prevent displacements in the direction transverse to the container walls; however, this is only when said measure is activated during driving. There is no connection when the vehicle is at a standstill.

In a practical embodiment, the restraints are formed, on the one hand, from a first molding with a defined contour and, on the other hand, from a second molding with a negative contour matching the latter, one of the two moldings being capable of being brought into positive engagement with the other molding. In particular, one molding is a tenon projecting from the wall of one container into the interspace between the outer container and the inner container, and the other molding is a ring projecting from the wall of the other tank and matching the tenon, one of the two moldings being displaceable in the direction of the other molding.

Thus, one of the moldings is mounted on the inside of the outer container and the other on the outside of the inner container, in which case, depending on the form of the tank and other considerations, it is selectable which of the moldings is displaceable and which is fixed and which has the positive and which the negative contour.

There are various possibilities for displacing one molding or the other. Either the displaceable molding is arranged on a shoe deformable in a bimetal-like manner, in which case this shoe is preferably mounted on the inside of the outer container and may be equipped with resistance heating. Or the displaceable molding is a permanent magnet which can be repelled by means of a separately excited magnet mounted on the outer wall of the outer container. Owing to the repulsion, said permanent magnet is brought into engagement with the other molding, without the wall needing to be perforated. For this purpose, a third molding may also be firmly mounted on the other container wall in each case.

BRIEF DESCRIPTION OF THE DRAWINGS

The invention is described and explained below with reference to figures in which:

FIG. 1: illustrates a tank according to the invention in a first embodiment, diagrammatically in cross section, with the detail A extracted.

DETAILED DESCRIPTION

Figure 3:
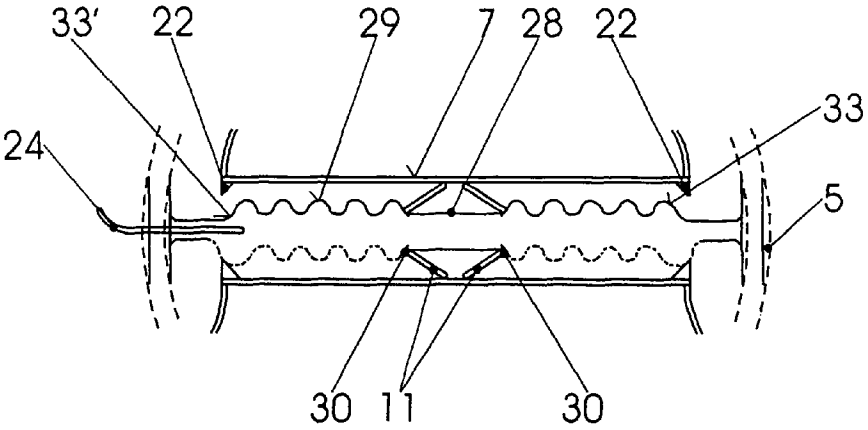
FIG. 3: illustrates a variant of FIG. 2, FIG. 4: illustrates the same as FIG. 1, in a third embodiment.

In FIG. 1, the outer container is designated by 1 and the inner container received approximately equidistantly in the latter is designated by 2. The outer container 1, the longitudinal direction of which may be thought of as being normal to the image plane, consists of a cylindrical lower part 3, of an elongate dome-like upper part 4 and of a transition part 5 which appears to be straight in the image plane. Between the inner container 2 and the outer container 1, there is an interspace 6, which contains highly effective heat insulation, for example a multilayer vacuum insulation. A tubular perforation can be seen in the inner container 2, and a further perforation could also be provided in front of or behind the image plane. A hollow body 8, designed here as a carrying tube, runs, concentrically to the tubular perforation 7, between fastenings 9, 10 on the two mutually opposite sides of the outer container 1, approximately level with the transition part 5. The inner container is suspended on this hollow body 8 by means of spatially arranged tension or compression struts 11. These are arranged in such a way that displacements of the inner container 2 with respect to the outer container 1 caused by thermal expansion differences are compensated for and/or absorbed. In order to protect the inner container 2 against displacements with respect to the outer container 1 in the direction of extent of the container wall, restraints 16 may additionally also be provided.

In the embodiment of FIG. 1, the fastening parts 9, 10 of the outer container 1 have formed in them abutments 13 which project inward on both sides and which can be displaced inward on the hollow body 8 by means of an actuator 14, for example an electromagnet. For this purpose, either said abutments pass through the fastenings 9, 10, so that the electromagnet 14 can engage directly, or the abutments 13 are themselves permanent magnets which, when the outer electromagnets 14 are activated, are repelled and are thus pressed inward. In the form of instance, a sealing diaphragm 15 is required. The latter must be gastight, so that the vacuum in the interspace 6 and inside the perforation 7 is maintained. The abutments 13 co-operate on both sides with supporting faces 12 which are formed as conical faces on the two outlet edges of the perforation 7 to form a coupling means.

In FIG. 1, the abutments do not bear against the supporting faces 12. The inner container is connected to the outer container 1 only by means of the tension or compression struts 11. This first position corresponds to the standstill of the motor vehicle, during which normally no vibrations of any kind occur. The tension or compression struts 11 can thus be designed to be very lightweight and with a very small cross section, so that they form only minimal heat bridges. In the extracted detail A, the abutment 13 bears against the supporting face 12, with the sealing diaphragm 15 being interposed. In this second position, the inner container 2 is firmly connected, free of play, to the outer container 1, the inner container is thus secured in the outer container 1 and the tension or compression struts are not subjected to load.

Figure 2:
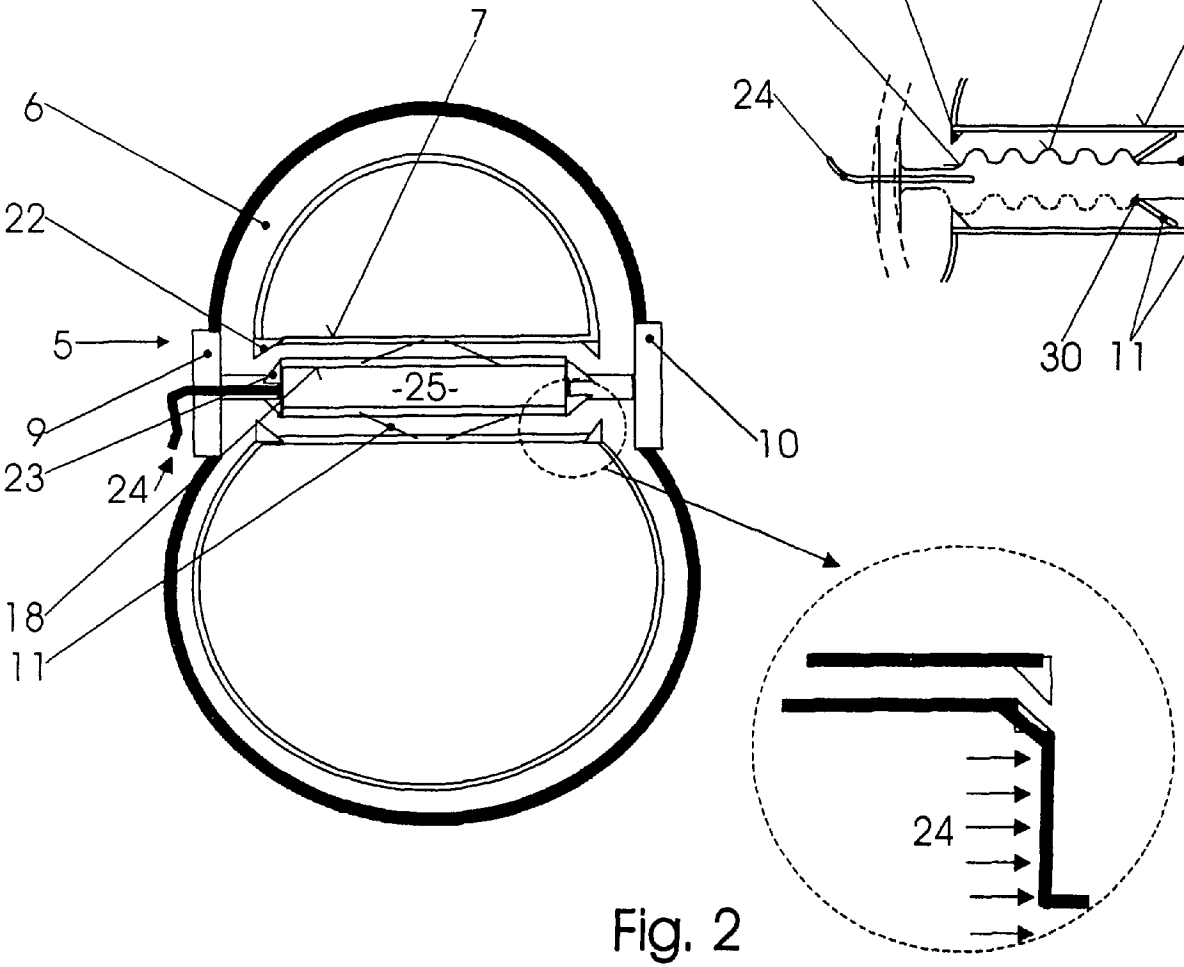
FIG. 2: illustrates the same as FIG. 1, in a second embodiment.

In FIG. 2, identical components bear the reference symbols of the preceding figure. This embodiment differs in that a hollow body 18 is provided, which is extendable in its longitudinal direction and on which the abutments 23 are formed. Said hollow body is again connected to the inner container 2 by means of the tension or compression struts 11. The supporting faces 22 are annular conical faces, this time with an inwardly open cone, because the abutments 23 lie within the supporting faces 22. Said abutments are brought to bear in that, by means of a line 24, pressure medium is supplied to or discharged from the pressure space 25 formed inside the hollow body 18. In the event of an increase in pressure, the abutments 23 are shifted or displaced until they touch the supporting faces 22.

In the variant of FIG. 3, the hollow body 28 is designed in a very special way. It is designed, on both sides between the abutment 33 and a shoulder 30 for the engagement of the tension or compression struts, as a bellows 29 which changes its length in the event of a change in the internal pressure. In this case, there may be provision for the walls of the outer container 1 to yield outwardly in a diaphragm-like manner in the straight transition part 5, this being indicated by broken lines. When pressure is applied through the line 24, the two bellows 29 are lengthened and, on each side, bring the abutment 33 to bear against the supporting faces 22, this being illustrated likewise by broken lines. The inner container is consequently secured in the outer container.

Figure 4:
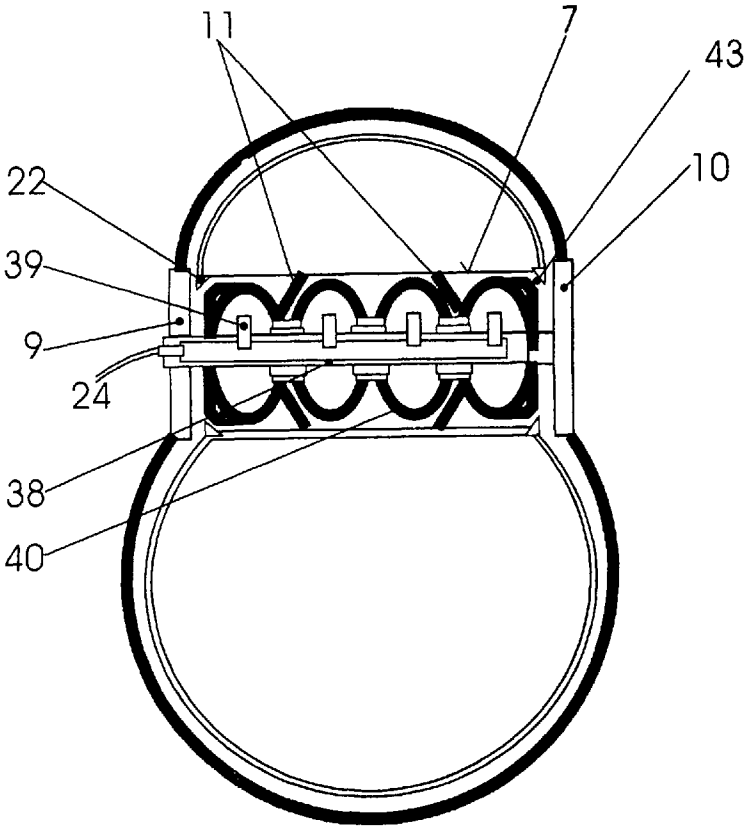

The variant of FIG. 4 differs from the preceding variants in that the hollow body 38, which is fastened in the outer container 1 at 9 and 10 and which can again be connected to a pressure source by a line 24, is connected via passages 39 to bellows-like structures 40 consisting of an elastic material. Four individual bellows-like structures 40 of this type can be seen in the figure, and the tension or compression struts 11 can engage between two of these in each case. Said structures could, however, also be provided elsewhere, that is to say outside the tubular perforations 7, as is applicable to all the variants described. The material properties of the bellows-like structures 40 are selected such that they expand to the desired extent both in the radial and in the axial direction. As a result, with their abutments 43 formed on the respective outer bellows-like structure, they can co-operate with the supporting faces designed as in the version of FIG. 2. They may, however, also widen in the radial direction, so that all the bellows-like structures 40 butt against the wall of the tubular perforation 7.

Figure 5A:
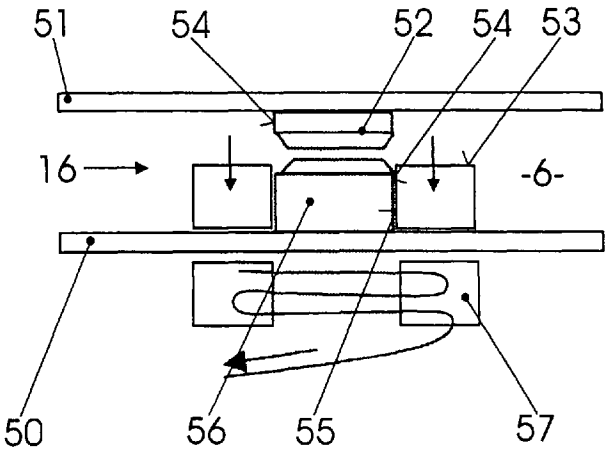
FIG. 5: illustrates a detail B in FIG. 1, in a first embodiment, a) in a released position, b) in a restrained position.
Figure 5B:
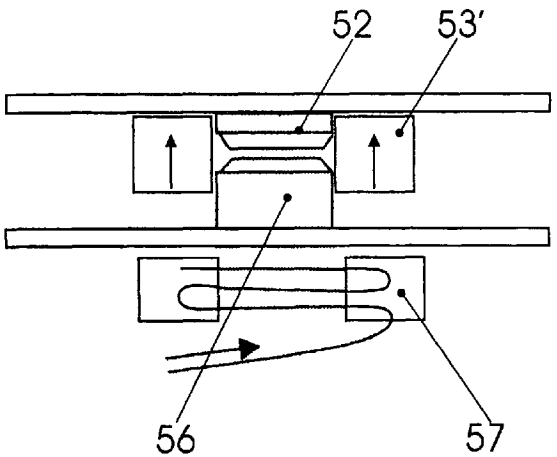

FIG. 5 shows a restraint 16 additionally provided. Of the entire container, only a piece of the wall 50 of the outer container and a piece of the wall 51 of the inner container can be seen. A first molding 52 is fastened to the latter wall and a third molding 56 is fastened to the wall 50 of the outer container. Moreover, a second molding is provided, which can be moved in the normal direction to the walls 50, 51. The contour 54 of the first molding 52 and of the third molding 56 corresponds to the negative contour 55 of the second molding 53. When the first and third moldings 52, 56 are tenons of circular cross section, the second molding is a circular ring. It is designed as a permanent magnet. A separately excited magnet 57 is provided outside the wall 50 of the outer container. Depending on the polarity of the current supplied, said magnet either attracts the second molding 53, which is in the position shown in FIG. 5*a*, or repels it, see FIG. 5*b*. In this position, the second molding 3 connects the first molding 52 and the third molding 56 positively. In this position, the walls 50, 51 cannot be displaced in parallel relative to one another.

Figure 6A:
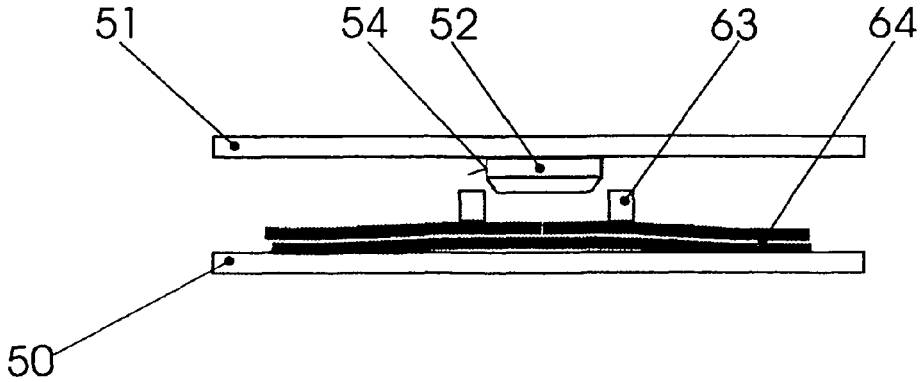
FIG. 6: illustrates a detail B in FIG. 1, in a second embodiment, a) in the released position, b) in the restrained position.
Figure 6B:
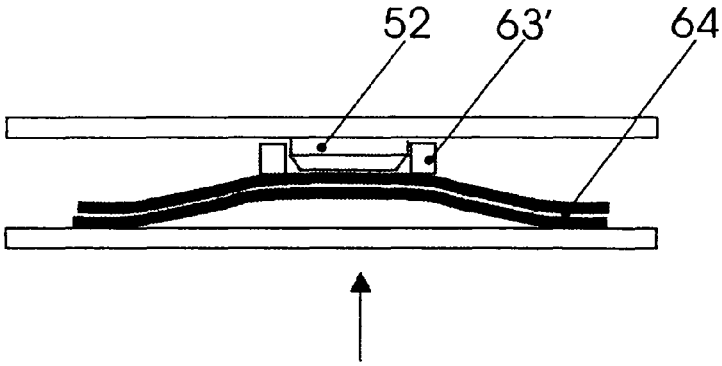

In the variant of FIG. 6, the second molding 52 is mounted as before, but the second molding 63 is mounted on a bimetallic shoe 64. The bimetallic shoe 64 is firmly connected on one side to the wall 50 of the outer container. In the position of FIG. 6*a*, the bimetallic shoe 64 is flat and the second molding 63 does not co-operate with the first molding 52; a displacement of one of the two walls is possible per se. If, then, a specific temperature change occurs, as may also take place due to resistance heating installed in the bimetallic shoe 64, the shoe curves up and brings the second molding 63 into the position 63' in which it positively surrounds the first molding 52.

The restraints described again follow the teaching according to the invention. With the vehicle at a standstill, they do not touch one another, and, when the vehicle is in operation, they prevent a relative movement of the walls 50, 51 of the inner container and outer container in the direction of their extent. In the embodiment of FIG. 6, the restraint may additionally also exert a force acting normally to the walls 50, 51.

The invention claimed is:

1. A tank for cryogenic liquids for use in a motor vehicle comprises an outer container, an inner container suspended in the outer container by spatially arranged strut means for compensating for displacements of the inner container due to thermal expansion, and selectively actuatable coupling means for selectively securing the inner container within the outer container, said coupling means being located between the outer container and inner container, and said coupling means being selectively movable from a first position wherein said coupling means is disengaged when the motor vehicle is at a standstill to a second position wherein said coupling means is engaged when the vehicle is in motion for securing the inner container within the outer container.

2. The tank as claimed in claim 1, wherein the coupling means comprises supporting faces formed on the inner container, abutments co-operating with said supporting faces arranged inside the outer container and actuator means for engaging said abutments and supporting faces.

3. The tank as claimed in claim 2, wherein the actuator means is an electromagnet mounted on the outer container and the abutment is covered by a sealing diaphragm.

4. The tank as claimed in claim 1, wherein the coupling means comprises supporting faces formed on a tubular perforation of inner container, and the abutments co-operating with said supporting faces are formed by a hollow body which is arranged inside the outer container and passes through the tubular perforation of the inner container, wherein the form of the hollow body varies as a function of the internal pressure, and wherein the hollow body and the supporting faces are centrically symmetrical.

5. The tank as claimed in claim 4, wherein the hollow body has ends connected to the outer container by means of fastenings, and the spatially arranged tension or compression struts of the suspension of the inner container also engage on said outer container.

6. The tank as claimed in claim 5, wherein the outer container is deformable in a diaphragm-like manner in the surroundings of the fastenings of the hollow body, and the hollow body is designed at least partially as a bellows.

7. The tank as claimed in claim 4, wherein the hollow body is surrounded by centrically symmetrical bellows-like structures which are expandable by means of internal pressure and which can thus be brought to bear against the supporting faces and/or the tubular perforation of the inner container.

8. The tank as claimed in claim 1, wherein the coupling means comprises restraints formed, on the one hand, from a first molding with a defined contour and, on the other hand, from a second molding with a negative contour matching the former, wherein one of the two moldings is brought into positive engagement with the other molding when the coupling means is engaged.

9. The tank as claimed in claim 8, wherein one molding is a tenon projecting from a wall of one container into an interspace, and the other molding is a ring projecting from a wall of the other container and matching the tenon, one of the two moldings being displaceable in the direction of the other molding.

10. The tank as claimed in claim 9, wherein the displaceable molding is arranged on a bimetal shoe.

11. The tank as claimed in claim 10, wherein the bimetal shoe is equipped with resistance heating.

12. The tank as claimed in claim 9, wherein the displaceable molding is a permanent magnet which can be repelled by means of a separately excited magnet mounted outside on the outer container.

* * * * *